United States Patent [19]

Tomita et al.

[11] 4,123,762

[45] Oct. 31, 1978

[54] IMPROVED ELECTROSTATIC HEAD WITH TONER-REPELLING ELECTRODE

[75] Inventors: Satoru Tomita; Tamio Ohori; Shuichi Karasawa, all of Tokyo, Japan

[73] Assignee: Ricoh Company, Ltd., Tokyo, Japan

[21] Appl. No.: 752,599

[22] Filed: Dec. 20, 1976

[30] Foreign Application Priority Data

Dec. 26, 1975 [JP] Japan ..... 50/156512

[51] Int. Cl.[2] ..... G03G 15/08; B05C 5/02

[52] U.S. Cl. ..... 346/155; 118/639; 355/3 TR

[58] Field of Search ..... 346/155, 153; 355/3 DD, 355/3 TR, 12; 118/647, 648, 638, 639

[56] References Cited

U.S. PATENT DOCUMENTS

| | | | |
|---|---|---|---|
| 3,428,025 | 2/1969 | Sullivan | 118/647 |
| 3,519,118 | 7/1970 | Reszka | 346/154 |
| 3,626,422 | 12/1971 | Lloyd | 346/155 |
| 3,662,396 | 5/1972 | Brown | 346/154 |
| 3,981,268 | 9/1976 | Tsukamoto | 355/3 DD |

*Primary Examiner*—Jay P. Lucas
*Attorney, Agent, or Firm*—Frank J. Jordan

[57] ABSTRACT

Liquid or dry developing substance comprising charged particles is applied to a base electrode in the form of a rotary cylinder. A sheet of recording paper is fed in contact with the cylinder. A printing head comprises a plurality of printing electrode sets formed into an array such as a rectangular dot matrix in which each electrode set constitutes a row of the matrix. Each electrode set comprises a plurality of shaping electrodes which constitute the individual data points of the row. At least one bias electrode is provided for each electrode set. Row select wires are connected to the bias electrodes of the electrode sets respectively. Shaping electrode or column select wires are connected to the shaping electrodes of all of the electrode sets in such a manner that a particular column select wire is connected to the shaping electrodes of all of the electrode sets in a corresponding column. A high voltage of the same polarity as the charged particles applied to the bias electrodes causes the charged particles to be repelled against the surface of the cylinder and prevents printing. The voltage on the bias electrodes is lowered one row at a time to sequentially enable the rows for printing. The lower voltage also repels the charged particles against the surface of the cylinder but can be overcome by a higher voltage of a polarity opposite to the charged particles applied to the shaping electrodes of the selected row corresponding to the data points of the row which are to be printed. The interaction of the electric fields of the bias electrode and the shaping electrodes causes the attractive field of the shaping electrodes to be present only directly under the faces of the shaping electrodes thereby providing high printing resolution.

15 Claims, 10 Drawing Figures

IMPROVED ELECTROSTATIC HEAD WITH TONER-REPELLING ELECTRODE

BACKGROUND OF THE INVENTION

The present invention relates to an electrostatic printing apparatus comprising an improved printing electrode head.

U.S. Pat. No. 3,898,674 to Koch discloses improvements to a non-impact printer which is disclosed in U.S. Pat. No. 3,550,153 to Haeberle. In this printer, a pulsed electric field is applied between a shaping and base electrode through a donor sheet and a closely adjacent recipient sheet to transfer electrically conductive printing material particles from the donor sheet to the recipient sheet. A shield electrode is disclosed by Koch which cancels the fringe components of the pulsed electric field emanating from points on the surface of the shaping electrode outside the printing face in order to reduce the size of the printed mark and increase the resolution of the system. An important aspect of this prior art printer is that a gap must be maintained between the donor sheet and the recipient sheet. The shaping electrodes may be arranged in, for example, a dot matrix array. However, Koch does not disclose any specific method or apparatus for interconnecting and energizing the shaping electrodes of a dot matrix array for printing.

The present invention constitutes an improvement to an electrostatic printer which eliminates the need for a donor sheet and thereby the cost of printing. In such a printer, a rotary cylinder is coated with a liquid or dry layer of a developing substance comprising charged particles of pigment or the like and a recording sheet, which may be an ordinary sheet of writing paper, is fed in contact with the cylinder. A printing head is positioned closely adjacent to the cylinder so that the recording sheet is disposed between the cylinder and printing head. The printing head comprises a plurality of shaping electrodes arranged in a dot matrix configuration. A voltage applied to selected shaping electrodes attracts adjacent particles to the recording sheet for printing, with the particles being later thermally or otherwise fixed to the recording sheet to provide a permanent record.

A problem which has heretofore remained unsolved in this type of system is that since the developing substance is maintained in contact with the recording sheet charged particles will adhere to the recording sheet even in non-printing areas. This creates a smeary appearance and severely limits the contrast which can be provided by the printer. Another problem which has remained unsolved is that of interconnecting the shaping electrodes for selective energization. The packing density of the electrodes in a high resolution printer may be as high as 4–10 per millimeter, and the wiring problem has been extreme.

SUMMARY OF THE INVENTION

The present invention overcomes the problem of particle adherence to non-printing areas of a recording sheet through the use of at least one biasing electrode associated with each shaping electrode set which repels the charged particles against the surface of the cylinder. A sufficient voltage of opposite polarity is applied to the shaping electrodes to overcome the effect of the bias voltage and attract charged particles to the recording sheet only in the desired printing areas immediately adjacent to the shaping electrodes. The effect is maximized consistent with the non-production of electrical discharge between the shaping electrodes and the biasing electrodes by having the shaping electrodes extend slightly closer to the recording sheet than the bias electrodes. The wiring problem is overcome by means of controlling the voltage on the bias electrodes for row selection. The wires of all of the shaping electrodes in each column are connected together for data point selection, thereby eliminating the need for individual wires leading to the respective shaping electrodes and drastically reducing the wiring density.

It is an object of the present invention to provide an electrostatic printing apparatus comprising an improved printing electrode head which eliminates the adherence of particles of printing material to non-printing areas of a recording sheet.

It is another object of the present invention to provide an electrostatic printing apparatus capable of improved printing contrast.

It is another object of the present invention to provide an electrostatic printing apparatus capable of improved resolution.

It is another object of the present invention to provide an electrostatic printing apparatus comprising a unique printing electrode array with drastically reduced wiring density and fabrication cost.

It is another object of the present invention to provide a generally improved non-impact electrostatic printing apparatus.

Other objects, together with the foregoing, are attained in the embodiments described in the following description and illustrated in the accompanying drawing.

DESCRIPTION OF THE PREFERRED EMBODIMENTS

While the electrostatic printing apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
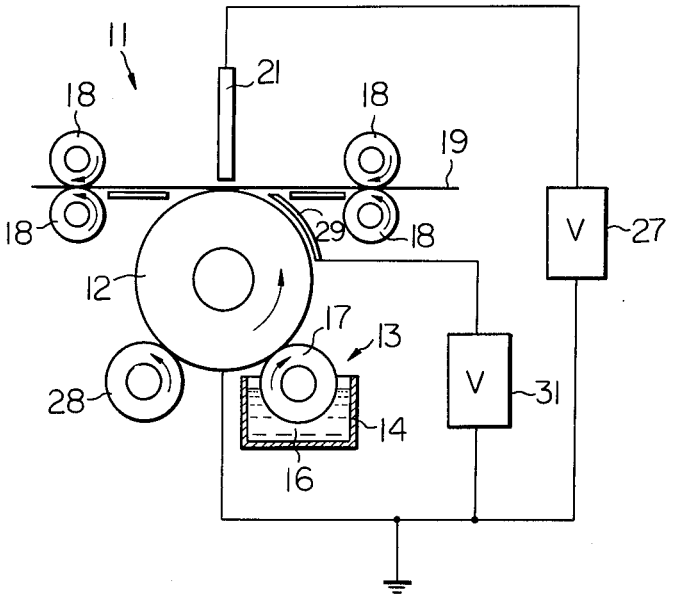
FIG. 1 is a schematic view of an electrostatic printing apparatus embodying the present invention.

Referring now to FIG. 1 of the drawing, an electrostatic printing apparatus embodying the present invention is generally designated by the reference numeral 11 and comprises a base electrode in the form of a rotary cylinder 12 which is driven for counterclockwise rotation at constant speed. A developing unit 13 comprises a developing tank 14 filled with a developing substance 16 which may be in liquid or dry form. Where the developing substance 16 is in liquid form, it comprises a liquid carrier in which is suspended a large number of fine charged particles of pigment or the like. Where the cylinder 12 is grounded as shown, the particles of developing substance may be given a negative charge. Where the developing substance is in dry form, it may be constituted by charged particles similar to those of the liquid developing substance with the liquid carrier omitted.

The developing unit 13 further comprises an applicator which is symbolically shown as a roller 17 driven for clockwise rotation in brushing contact with the cylinder 12. The lower portion of the roller 17 is immersed in the developing substance 16 so that it becomes coated with the developing substance 16 upon rotation. The roller 17 transfers the developing substance 16 to the cylinder 12 through contact therewith in such a manner that an even coating of the developing substance 16 is applied to the cylinder 12.

Feed rollers 18 are provided to feed a recording sheet 19 in contact with the surface of the cylinder 12 from right to left as viewed in FIG. 1. In this manner, the lower surface of the recording sheet 19 contacts the developing substance 16 on the cylinder 12. The recording sheet 19 need not be made of any special material, and even ordinary writing paper may be used.

A printing head 21 is disposed above the cylinder 12 closely adjacent thereto so that the recording sheet 19 is disposed between the cylinder 12 and the printing head 21. The printing head 21 comprises a plurality of printing electrode assemblies or units, each being designated by the reference numeral 20. For simplicity of illustration, only a few of the printing electrode units 20 are labeled in FIG. 2. In the exemplary embodiment shown herein, the printing electrode units 20 are pressed into holes (not designated) formed in an insulative block 23 and arranged in a rectangular dot matrix of five columns by seven rows. The five printing electrode units 20 in each row are considered as constituting printing electrode sets S1 to S7 respectively.

Figure 3:
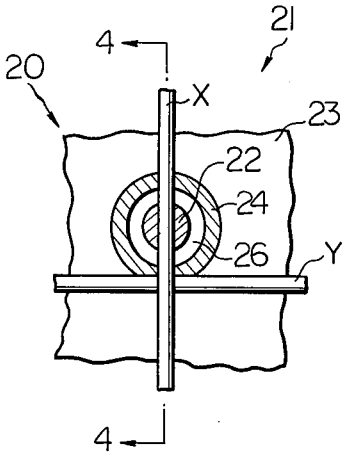
FIG. 3 is a plan view of a printing electrode assembly of the printing apparatus.
Figure 4:
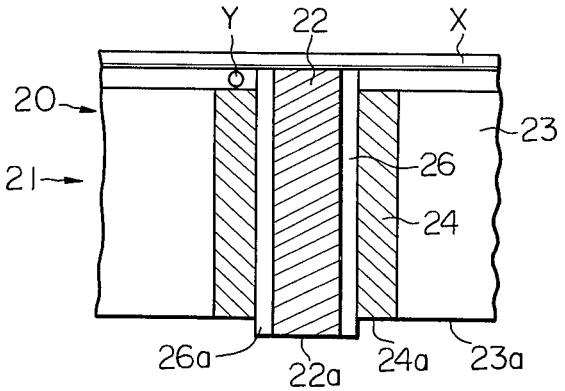
FIG. 4 is a vertical sectional view of the printing electrode assembly taken on a line 4—4 of FIG. 3.

One printing electrode unit 20 is shown in enlarged form in FIGS. 3 and 4 and comprises a shaping electrode 22 which is in the form of a rod oriented perpendicular to the surface of the cylinder 12. In other words, the longitudinal axis of each shaping electrode 22 lies substantially perpendicular to and intersects the longitudinal axis of the cylinder 12, with a lower end 22*a* of each shaping electrode 22 being positioned adjacent to the cylinder 12. Each unit 20 further comprises a bias electrode 24 pressed in the respective hole in the block 23. Each bias electrode 24 is formed with a bore (not designated) in which is press fitted a cylindrical insulator 26. The insulator 26 is in turn formed with a bore (not designated) in which is press fitted the shaping electrode 22. It will be seen that each shaping electrode 22, insulator 26 and bias electrode 24 are mutually coaxial.

In accordance with an important feature of the present invention, the lower end 24*a* of each bias electrode 24 is recessed relative to the lower end 22*a* of the shaping electrode 22. In other words, the shaping electrodes 22 extend closer to the cylinder 12 than do the bias electrodes 24. The lower end 26*a* of each insulator 26 is preferably flush with the lower end 22*a* of the respective shaping electrode 22. The lower end 23*a* of the block 23 is preferably flush with the lower ends 24*a* of the bias electrodes 24.

Figure 2:
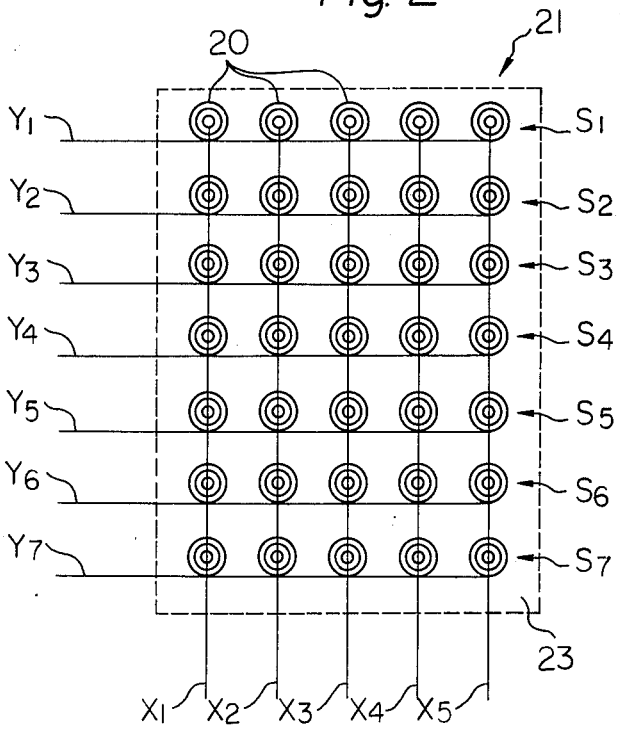
FIG. 2 is a schematic view of a printing head of the apparatus comprising electrodes arranged in a dot matrix configuration.

As shown in FIG. 2, printing electrode set or row select wires Y1 to Y7 are ohmically connected to the bias electrodes 24 of all of the printing electrode units 20 of the printing electrode sets S1 to S7 respectively. In a similar manner, shaping electrode or column select wires X1 to X5 are connected to the shaping electrodes 22 in corresponding positions of all of the printing electrode sets S1 to S7 respectively. More specifically, the wire X1 is connected to the shaping electrodes 22 of all of the printing electrode units 20 in the leftmost positions in the printing head 21. The wire X5 is connected to the shaping electrodes 22 of all of the printing electrode units 20 in the rightmost positions in the printing head 21. The wires X2, X3 and X4 are connected to all of the shaping electrodes 22 in the respective columns.

As best seen in FIG. 4, the insulator 26 and shaping electrode 22 of each printing electrode set 20 preferably extends above the bias electrode 24 and block 23. This facilitates easy fabrication of the printing head 21. To attach the printing electrode set select wires Y1 to Y7, it is merely necessary to lay the wires Y1 to Y7 on the block 23 so that the respective wires Y1 to Y7 contact the respective bias electrodes 24. The wires Y1 to Y7 are then easily connected to the upper ends of the respective bias electrodes 24 by a well known spot welding or similar technique. After the assembly of the wires Y1 to Y7, the wires X1 to X5 are positioned on the respective shaping electrodes 22 and spot welded into place. This unique arrangement of the invention allows high density arrays to be fabricated easily, quickly and cheaply since individual wires are not required for each shaping electrode 22. To avoid contact of the wires X1 to X5 with the wires Y1 to Y7, the shaping electrodes 22 are designed to protrude above the bias electrodes 24 by a distance greater than the diameter of the wires Y1 to Y7. In FIGS. 3 and 4, the characters X and Y designate the wire X1 to X5 and the wire Y1 to Y7 of the representative printing electrode unit 20 shown.

In operation, the rollers 18 feed the recording sheet 19 into contact with the cylinder 12. A voltage source 27 normally applies a high negative voltage of, for example, −500VDC to all of the wires Y1 to Y7 so that the negative potential is applied to all of the bias electrodes 24. This negative electric field repels the negatively charged particles of the developing substance 16 away from the recording sheet 19 against the surface of the cylinder 12. Where the developing substance 16 is in liquid form, the external strata of the developing substance 16 which contacts the recording sheet 19 is completely free of charged particles.

When the recording sheet 19 reaches a printing position relative to the printing head 21, a character generator which constitutes part of the voltage source 27 selectively changes the voltages on the wires X1 to X5 and Y1 to Y7 in a manner which will be described in detail. The character generator is not the subject matter of the present invention and is not specifically shown.

The printing electrode sets S1 to S7 are enabled one at a time in sequence to print the rows of the desired character from the upper row to the lower row. This is accomplished by means of the character generator in the voltage source 27 which sequentially reduces the negative voltage on the wires Y1 to Y7 to, for example, −150VDC. With the voltage on the wire Y1 reduced to −150VDC, the printing electrode set S1 is enabled for printing the first row.

The particular data points on the first row are energized for printing by applying a high positive voltage of, for example, +650VDC to the wires X1 to X5 corresponding to the data points to be printed. This voltage is applied to the respective shaping electrodes 22 of the printing electrode set S1 and also to the corresponding shaping electrodes 22 of the sets S2 to S7. However, this positive voltage is insufficient to overcome the high negative voltage on the biasing electrodes 24 of the printing electrode sets S2 to S7. However, it is sufficient to overcome the low negative voltage on the bias electrodes 24 of the printing electrode set S1.

The positive voltage on the selected electrodes of the upper printing electrode set S1 causes the creation of a positive electric field in the form of a narrow tunnel or column to extend from the energized shaping electrodes 22 through the recording sheet 19 into the developing substance on the cylinder 12. This attracts charged particles from the surface of the cylinder 12 onto the surface of the recording sheet 19 only in the area directly below the shaping electrodes 22. After a sufficient length of time for the particles to be attracted to the recording sheet 19, the voltage source 27 switches the voltage on the wire Y1 to the high negative value to inhibit the printing electrode set S1 and switches the voltage on the wire Y2 to the low negative value to enable the printing electrode set S2. Simultaneously, the voltage source 27 applies the positive voltage to the wires X1 to X5 corresponding to the data points to be printed in the second row. This process is repeated until all of the printing electrode sets S1 to S7 have been sequentially enabled and the 7 rows of the matrix have been printed. Relative movement is then effected between the recording sheet 19 and the printing head 21 to print subsequent characters.

If the apparatus 11 is designed as a serial printer, the printing head 21 is moved transversely relative to the recording sheet 19 to sequentially print the characters of each line. After printing each line, the rollers 18 feed the recording sheet 19 by one row position to print the next line. Where the apparatus 11 is designed as a line printer, a recording head 21 is provided for each character position. The recording heads are energized in series by a scanning unit or in parallel to print a line. Line feed is by means of the rollers 18 as in the serial line printing arrangement.

After printing, the recording sheet 19 is fed away from the cylinder 12 by the rollers 18 and the developing particles are thermally or otherwise fixed thereto to provide a permanent record. After the printing process is completed, a cleaning unit symbolically illustrated as a roller 28 driven for counterclockwise brushing engagement with the cylinder 12 removes the developing substance 16 therefrom for recycling.

The operation of the apparatus 11 may be enhanced by providing an arcuate electrode 29 closely adjacent to the cylinder 12. A voltage source 31 applies a negative voltage to the electrode 29 so that the charged particles are repelled against the surface of the cylinder 12 before reaching the printing head 21.

Although the specific embodiment shown and described thus far comprises a grounded cylinder 12, negatively charged developer particles, negatively charged bias electrodes 24 and positively charged shaping electrodes 22, a number of other configurations are possible within the scope of the present invention. For example, single polarity voltage operation with negatively charged particles may be achieved by applying a positive potential to the cylinder 12 and selectively grounding and applying a low positive potential to the bias electrodes 24. In this case the charged particles are attracted to the cylinder 12 by the positive voltage thereon. The particles may be attracted to the recording sheet 19 by applying a high positive potential to the selected shaping electrodes 22.

Corresponding operations are possible using positively charged particles. In one form the cylinder 12 may be grounded, high and low positive voltages selectively applied to the bias electrodes 24 and a negative voltage of higher magnitude applied to the shaping electrodes 22 for printing. Single polarity operation may be achieved by applying a negative voltage to the cylinder 12, selectively grounding and applying a low negative potential to the bias electrodes 24 and applying a high negative voltage to selected shaping electrodes 22.

The particular configuration of the printing head 21 is an important feature of the invention. The effect of applying voltages to the bias electrodes 24 urging the charged particles against the surface of the cylinder 12 and applying a voltage to the shaping electrodes 22 to overcome the effect of the bias electrodes 24 and attract charged particles to the recording sheet 19 in an area substantially equal to the area of the lower ends **22*a* of the shaping electrodes 22 is maximized by making the insulators 26 as thin as possible thereby providing the bias electrodes 24 as close as possible to the shaping electrodes 22. However, at the voltages necessary for the operation of the apparatus 11, if the bias electrodes 24 are made too close to the shaping electrodes 22, an electrical discharge will occur therebetween which will seriously impair the performance of the apparatus 11. However, the present invention extends the shaping electrodes 22 closer to the cylinder 12 than the bias electrodes 24, with the lower ends 26*a* of the insulators 26 substantially flush with the lower ends 22*a* of the shaping electrodes 22. This increases the air gap between the electrodes 22 and 24 from the thickness of the insulators 26 which would be the case if the lower ends 22*a* and 24*a* were flush to the thickness of the insulators 26 plus the amount of protrusion of the shaping electrodes 22 past the bias electrodes 24. This enables the insulators 26 to be made thinner and the bias electrodes 24 spaced closer to the shaping electrodes 22 without the undesirable side effect of electrical discharge between the electrodes 22 and 24. With the tunnel effect of the positive electrical field from the shaping electrodes 22 enhanced, the apparatus 11** provides higher resolution and higher contrast printing than can be provided by comparable apparatus of the prior art.

Figure 5:
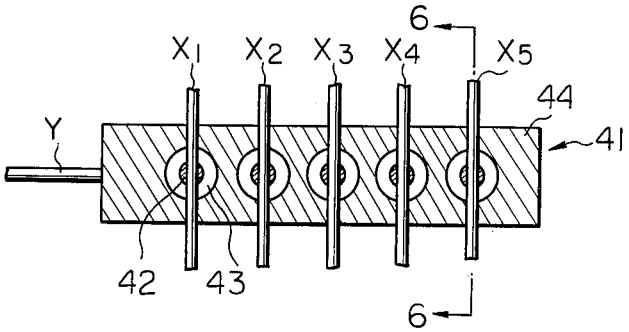
FIG. 5 is a plan view of a modified printing electrode assembly of the printing apparatus.
Figure 6:
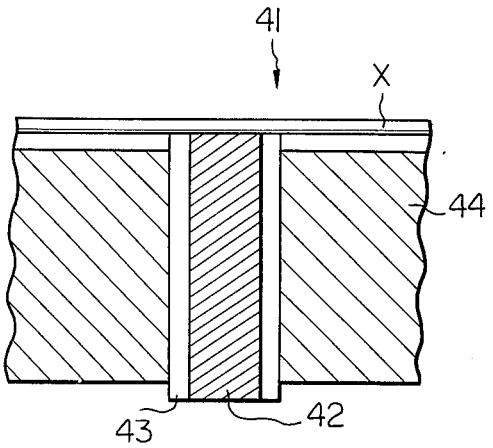
FIG. 6 is a vertical sectional view of the printing electrode assembly shown taken on a line 6—6 of FIG. 5.

FIGS. 5 and 6 illustrate a modified printing electrode set 41 which comprises shaping electrodes 42 and insulators 43, only one of each being labeled, which are essentially similar to the shaping electrodes 22 and insulators 26. In the printing electrode set 41, however, the insulative block 23 is replaced by a conductive block 44 and the cylindrical bias electrodes 24 are omitted, with the block 44 constituting the bias electrode. The printing head comprising the printing electrode set 41 features ease of construction and greater repulsion of the charged particles against the cylinder 12.

Figure 7:
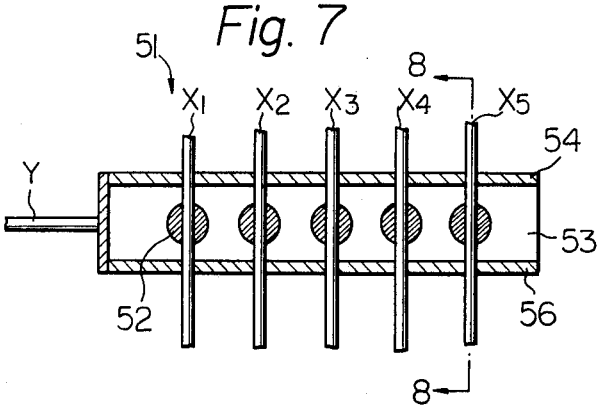
FIG. 7 is a plan view of another modified printing electrode assembly of the printing apparatus.
Figure 8:
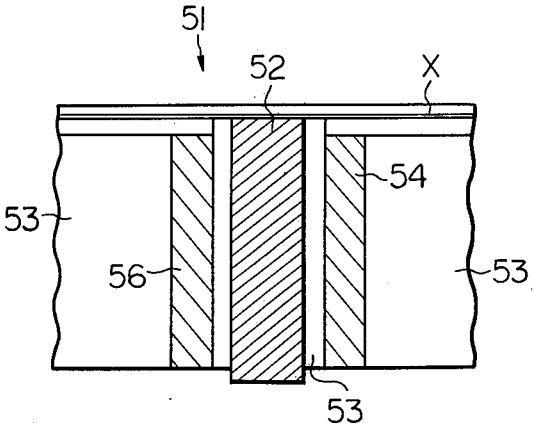
FIG. 8 is a vertical sectional view of the printing electrode assembly shown taken on a line 8—8 of FIG. 7.

FIGS. 7 and 8 illustrate another printing electrode set 51 which comprises shaping electrodes 52, only one being labeled, which are pressed into holes (not designated) formed in an insulative block 53. The bias electrode is constituted by two plates 54 and 56 which are attached to the block 53 on opposite sides thereof and may be used as structural members in the assembly of the printing electrode set 51. The plates 54 and 56 are normally electrically connected together for use.

Figure 9:
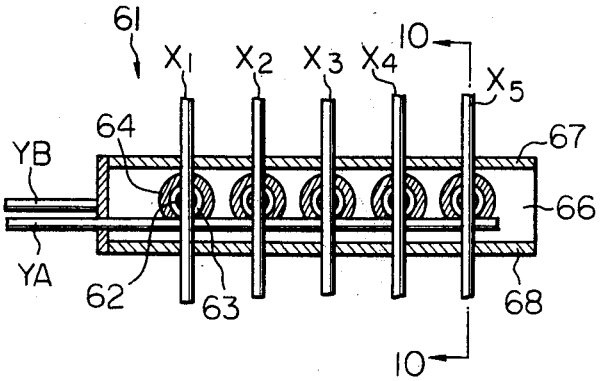
FIG. 9 is a plan view of yet another modified printing electrode assembly.
Figure 10:
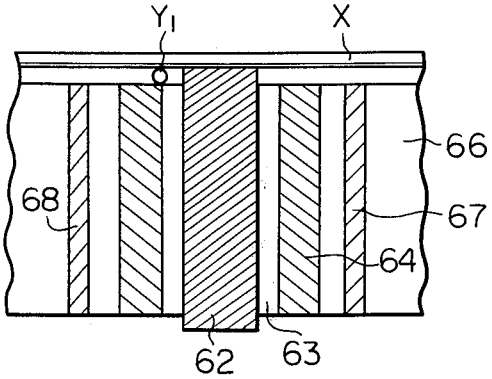
FIG. 10 is a vertical sectional view of the printing electrode assembly taken on a line 10—10 of FIG. 9.

FIGS. 9 and 10 illustrate yet another printing electrode set 61 which is a combination of the printing electrode sets 21 and 51. The printing electrode set 61 comprises shaping electrodes 62, insulators 63, and bias electrodes 64, only one of each being labeled, and an insulative block 66 which are essentially similar to the shaping electrodes 22, insulators 26, bias electrodes 24 and insulative block 23. In addition, the printing head 61 comprises two bias electrode plates 67 and 68 provided on opposite sides of the shaping electrodes 62.

The printing head 61 may be used in several ways. For example, the bias electrodes 64 and bias electrode plates 67 and 68 may be electrically connected together. Alternatively, repelling voltages of the same or different magnitudes may be applied to the bias electrodes 64 and plates 67 and 68 by means of low select wires YA and YB respectively. Whereas the voltages applied to the biasing electrodes 64 and plates 67 and 68 would be sufficient to prevent printing even with the voltage applied to the shaping electrodes 62, removal or reduction of the voltage on either the bias electrodes 64 or plates 67 and 68 would allow the voltage on the shaping electrodes 62 to overcome the bias voltage for printing.

In summary, it will be seen that the present invention overcomes the problems of low contrast, low resolution and smearing which have existed heretofore in electrostatic printing apparatus in which the recording sheet directly contacts the developing substance. In addition, the present invention sucessfully overcomes the problem of wiring density in high resolution printing electrode arrays to provide a printing electrode head which in simple in configuration and easy and inexpensive to manufacture on a commercial production basis. Many modifications will become possible for those skilled in the art after receiving the teachings of the present disclosure without departing from the scope thereof.

What is claimed is:

1. An electrostatic printing apparatus comprising;

a base electrode;

means for applying a developing substance including charged particles onto the base electrode;

a printing head including a plurality of printing electrode sets formed into an array, each printing electrode set including a plurality of shaping electrodes and a bias electrode and being disposed closely adjacent to the base electrode with the recording sheet disposed between the base electrode and the printing head;

a plurality of electrode set select wires connected to the bias electrodes of the printing electrode sets respectively;

a plurality of shaping electrode select wires each of which is connected to corresponding shaping electrodes of all of the printing electrode sets;

first voltage source means for selectively applying a first voltage to the shaping electrode select wires for printing; and second voltage source means for applying a selected one of a second and a third voltage to the electrode set select wires, the second and third voltages both urging the charged particles against the base electrode, the first voltage being insufficient to overcome the second voltage and being sufficient to overcome the third voltage to attract only those charged particles in areas of the base electrode adjacent to shaping electrodes to which the first voltage is applied to the recording sheet for printing.

2. An apparatus as in claim 1, in which the shaping electrodes are arranged to constitute a rectangular dot matrix.

3. An apparatus as in claim 1, in which each shaping electrode is in the form of a rod oriented perpendicular to the base electrode.

4. An apparatus as in claim 3, in which a bias electrode is provided for each shaping electrode, each bias electrode being in the form of a cylinder coaxially disposed around the respective shaping electrode.

5. An apparatus as in claim 4, further comprising a pair of bias electrode plates disposed on opposite sides of the bias electrodes.

6. An apparatus as in claim 5, further comprising an insulator disposed between the bias electrodes and bias electrode plates of each printing electrode set.

7. An apparatus as in claim 4, further comprising a cylindrical insulator coaxially disposed between each shaping electrode and each respective bias electrode.

8. An apparatus as in claim 3, in which one bias electrode is provided for each printing electrode set which is in the form of a block formed with a plurality of holes, the apparatus further comprising a cylindrical insulator disposed in each hole and being formed with a bore, the shaping electrodes being disposed in the bores respectively.

9. An apparatus as in claim 3, in which two bias electrodes are provided for each printing electrode set, the bias electrodes being in the form of plates disposed on opposite sides of the shaping electrodes.

10. An apparatus as in claim 1, further comprising an insulator disposed between each shaping electrode and each respective bias electrode.

11. An apparatus as in claim 1, in which the base electrode is in the form of a rotary cylinder.

12. An apparatus as in claim 1, in which the shaping electrodes extend closer to the recording sheet than the bias electrode.

13. An apparatus as in claim 1 in which the ends of the biasing electrodes and shaping electrodes opposite to the ends closest to the recording sheet are of unequal lengths to facilitate fabrication of the printing head.

14. An apparatus as in claim 1 wherein the electrode sets effect sequential printing.

15. An apparatus as in claim 1 in which second and third voltages are applied sequentially to thereby effect sequential printing by the array of printing electrode sets.

* * * * *